United States Patent [19]

Shimai

[11] 4,188,716

[45] Feb. 19, 1980

[54] APPARATUS FOR GAPPING A SLIDE FASTENER CHAIN

[75] Inventor: Hideo Shimai, Namerikawa, Japan

[73] Assignee: Yoshida Kogyo K.K., Tokyo, Japan

[21] Appl. No.: 930,972

[22] Filed: Aug. 4, 1978

[30] Foreign Application Priority Data

Aug. 10, 1977 [JP] Japan ..... 52-95696

[51] Int. Cl.[2] ..... B21D 53/50; B29D 5/00

[52] U.S. Cl. ..... 29/770

[58] Field of Search ..... 29/408, 409, 410, 766, 29/770

[56] References Cited

U.S. PATENT DOCUMENTS

| | | | |
|---|---|---|---|
| 2,885,774 | 5/1959 | Waldes | 29/408 |
| 2,987,809 | 6/1961 | Burbank | 29/408 |
| 3,063,323 | 11/1962 | Graf | 83/622 |
| 3,129,498 | 4/1964 | Runnels | 29/766 X |
| 3,391,441 | 7/1968 | Carlile | 29/408 |
| 3,490,133 | 1/1970 | Gundmeyer et al. | 29/408 |
| 3,631,581 | 1/1972 | Moertel | 29/408 |
| 3,663,000 | 5/1972 | Perlman | 29/408 |
| 3,844,017 | 10/1974 | Fisher et al. | 29/770 |
| 3,852,869 | 12/1974 | Shimai | 29/408 |
| 3,987,533 | 10/1976 | Sandgren | 29/410 |

*Primary Examiner*—E. M. Combs

*Attorney, Agent, or Firm*—Bucknam and Archer

[57] ABSTRACT

A method of providing a slide fastener chain with gaps free of fastener elements at predetermined interval is disclosed, the method comprising imparting a tendency to the fastener chain to spread the confronting longitudinal edges of its opposed stringer tapes prior to removal of the fastener elements, and maintaining constant tension over a length of the fastener chain, whereby the gaps can be formed accurately at predetermined locations along the length of the fastener chain. A preferred form and construction of apparatus tailored to carry this method into practice is also disclosed.

4 Claims, 8 Drawing Figures

APPARATUS FOR GAPPING A SLIDE FASTENER CHAIN

BACKGROUND OF THE INVENTION

1. Field of the Invention

This invention relates to a method and apparatus for gapping a slide fastener chain or removing a group of slide fastener elements from selected areas along a continuous length of slide fastener chain to provide "element-free gaps", the spacing between adjacent "gaps" largely determining the length of an individual finished slide fastener product.

2. Prior Art

Various methods and apparatus for gapping slide fasteners have been proposed heretofore. A typical example of the prior art methods and apparatus usually involves cutting the coupling head portions of the fastener elements and removing the cut pieces from the fastener tapes to leave gaps thereat free of fastener elements. To this end, the confronting, abutted edges of the tapes are required to be forced apart from each other widely enough to permit a punch to move therethrough. However, due to the tendency of the fastener tapes to resist the forcing apart or spreading open of their opposed element-carrying edges which have been brought into abutting engagement with each other, those portions of the tapes which lie between the locations of gaps to be formed and the withdrawal rollers disposed to guide the fastener chain out of the system, are prone to become elongated or stretched out. It has therefore been necessary, when predetermining the inter-gap spacing or intervals, to take into account such potential errors which may arise out of the elongation or stretching of the tapes. What makes this problem more complex is the fact that the material of the fastener tapes varies, it being a naturally occuring fiber in some instances or synthetic fibers in other instances, depending upon the garment or other articles to which the fastener is applied, or that the physical properties of the tapes also vary with whether they are woven or knitted, with the results that the rate of elongation of the tape under tensile force is variable with such varying conditions. Tape elongation is further subject to change with how rows of fastener elements are sewn to the support tapes, or even with the environmental conditions of the manufacture of fasteners. With conventional methods and apparatus, it has been difficult to determine the positions of "gaps" to be formed with reasonable accuracy, and it has been furthermore required to re-calibrate the equipment when the type of fastener chain changes.

SUMMARY OF THE INVENTION

Whereas, it is a primary object of the present invention to provide a method and apparatus for gapping a slide fastener chain at predetermined intervals along its length, which has been contrived to eliminate the aforesaid difficulties of the prior art.

It is a more specific object of the invention to provide an improved method which essentially comprises imparting a tendency to the stringer tapes to spread apart with minimum resistance at their opposed abutting edges where "gaps" are to be formed, and applying constant tension to the fastener chain between the feed and the withdrawal station so that "gapping" can take place exactly at predetermined intervals along a continuous length of slide fastener chain, and an improved apparatus tailor (1) to carry this method into practice.

According to the invention, there is provided a method of producing a series of gaps free of fastener elements in and along a continuous length of slide fastener chain having a pair of oppositely disposed stringer tapes each carrying along one longitudinal edge a row of fastener elements with coupling head portions and connecting portions, which method comprises the steps of imparting a tendency to the fastener chain to spread the confronting edges of its tapes apart; applying constant tension to a length of said fastener chain; spreading the confronting edges of its tapes apart; removing a group of said fastener elements from the fastener chain; and withdrawing the fastener chain intermittently along a length corresponding to the spacing between adjacent gaps to be produced.

The above method is carried into practice by apparatus for producing a series of gaps free of fastener elements in and along a continuous length of slide fastener chain having a pair of oppositely disposed stringer tapes each carrying along one longitudinal edge a row of fastener elements with coupling head portions and connecting portions, which apparatus comprises: a feeding unit having a drive and a pressure roller for transporting the fastener chain at a predetermined rate of speed; a prespreading unit having oppositely disposed guide arms, one movable relative to the other, defining therebetween a channel for the passage of the fastener chain; said unit including a plunger adapted to enter between and spread apart the confronting edges of the stringer tapes while the latter are being advanced; a tensioning unit having a guide rail, a weighted roller with a bearing movable along said rail and a guide roller located adjacent said feeding unit; a gapping unit having a punch and a die coacting in severing a group of fastener elements across their coupling head portions and a pair of grippers adapted to grip and remove the connecting portions of said group of elements from the respective tapes; and a withdrawing unit having a drive and a pressure roller for withdrawing the fastener chain intermittently along a length corresponding to the spacing between adjacent gaps to be produced.

Other objects and advantages of the invention will be more fully understood from the following detailed description taken in conjunction with the accompanying drawings which illustrate by way of example a preferred embodiment of the invention.

DETAILED DESCRIPTION OF THE PREFERRED EMBODIMENT

Figure 1:
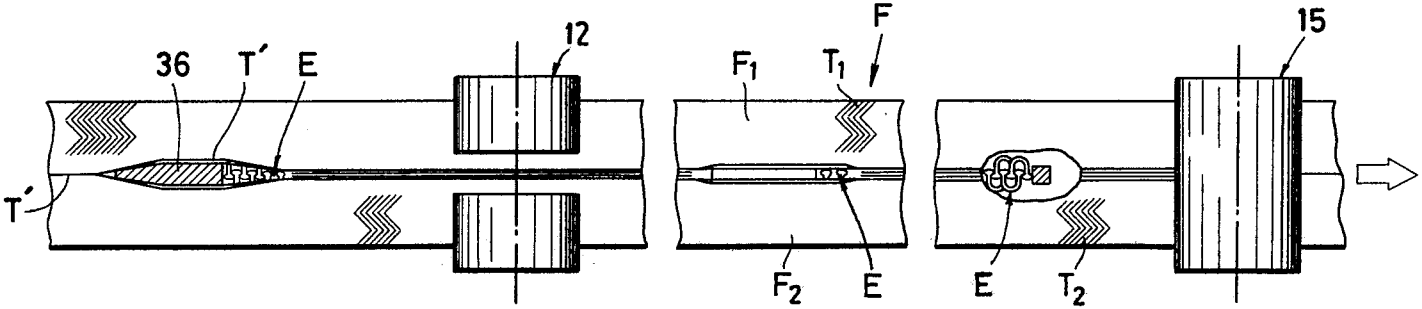
FIG. 1 is a schematic view utilized to explain the general process and equipment layout for gapping a slidefastener chain according to the invention.
Figure 2:
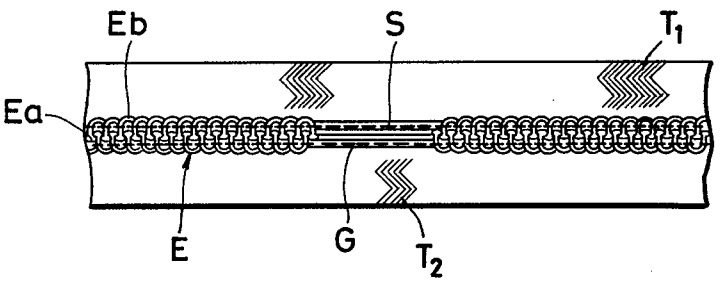
FIG. 2 is a top plan view of a pair of coupled fastener stringers provided with a gap devoid of fastener elements.

Referring now to the drawings and FIG. 1 in particular, there is schematically shown the steps of the gapping operation in accordance with the invention, in which a length of continuous slide fastener chain F is gapped at predetermined intervals while being transported under constant tension in the direction of the arrow. The fastener chain F is made up of a pair of oppositely disposed stringers $F_1$ and $F_2$, each including a support tape $T_1(T_2)$ having secured to its edge a row of filamentary coupling elements E which may be of a meander or helical formation, the two stringers $F_1,F_2$being shown coupled together. The rows of coupling fastener elements E each having a head portion Ea and connecting portions Eb are secured by sewing threads S. On its travel in the direction of the arrow, the fastener chain F moves initially past a pre-spreading station where the two interengaged stringers $F_1,F_2$ are imparted a physical tendency such that they can readily and easily spread apart when they are gapped at a later stage. The fastener chain F is then transported through a tensioning station where it is held under constant tension, and thence introduced into an element removing or gapping station where a group of fastener elements E is cut and removed from the fastener chain F, whereby the chain F is gapped; namely, provided with a tape section free of fastener elements E for purposes of the subsequent fastener finishing operation as well known in the art.

Figure 3:
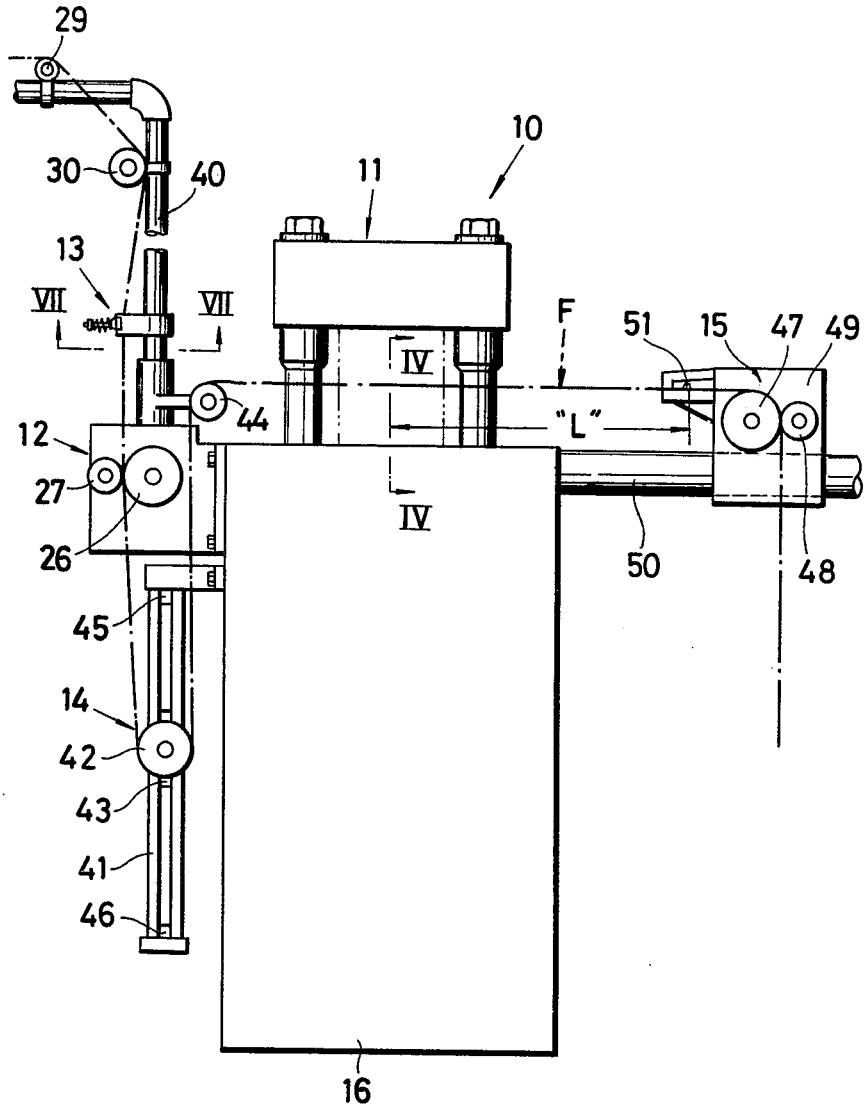
FIG. 3 is a schematic view in side elevation of an apparatus for gapping a slide fastener chain according to the invention.

The method of gapping a fastener chain above described is implemented by an apparatus generally shown in FIG. 3. The gapping apparatus generally designated at 10 comprises essentially a gapping unit 11, a feeding unit 12, a pre-spreading unit 13, a tensioning unit 14 and a withdrawal unit 15, all operatively associated in a manner to be described hereafter. The gapping unit 11 shown mounted on the top of the machine frame 16 includes a pair of fastener chain guides (not shown) for holding the fastener chain F face up; namely, with an element-carrying side up, in a horizontal position, the guides having a projection adapted to spread apart the confronting edges T' of the stringers $F_1,F_2$ and abut against the fastener elements E.

Figure 4:
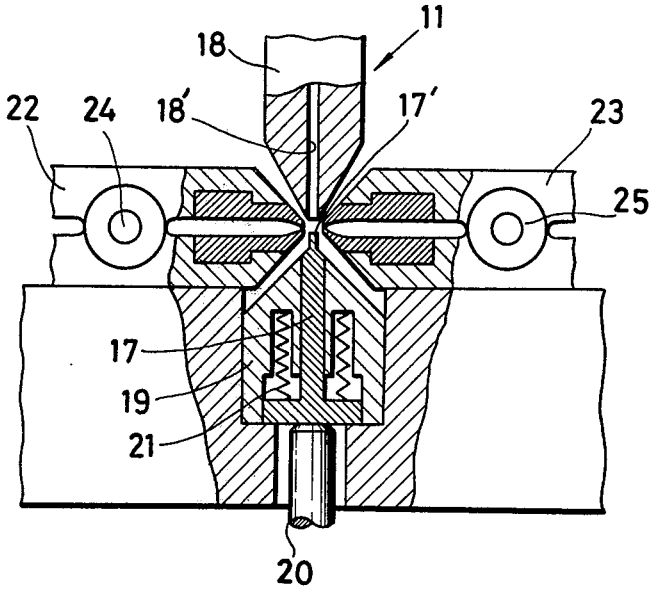
FIG. 4 is a schematic cross-sectional view taken on the line IV—IV of FIG. 3, which illustrates a mechanism for removing a group of fastener elements.
Figure 5:
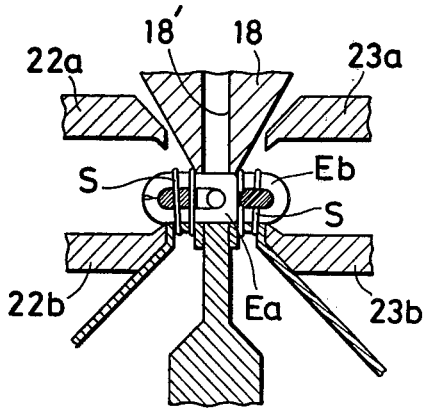
FIGS. 5 and 6 are schematic views in vertical section of the mechanism of FIG. 4, illustrating its operation.
Figure 6:
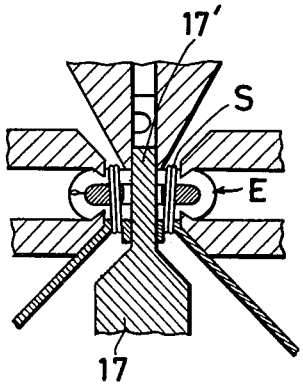

The gapping unit 11 further comprises, as better shown in FIGS. 4 through 6 inclusive, a vertically movable cutting punch 17 having a punch head 17' and a stationary die 18 having a die groove 18', the punch head 17' constituting with the die groove 18' a coacting die cutter for severing the coupling head portions Ea of the fastener elements E.

The punch 17 is situated below and in vertically opposed relation to the die 18 and mounted movably within a guide member 19. It is vertically reciprocated by an actuator 20. A spring 21 is disposed in the guide member 19 for normally positioning the punch head 17' in registry with the projection of the fastener chain guide or in close proximity with the lower surface of the stringer tapes $T_1,T_2$ as shown in FIG. 4. The gapping unit 11 further comprises a pair of horizontally opposed grippers 22,23 which are disposed in criss-cross relation to the vertically disposed punch 17 and die 18. The grippers 22,23 are each constituted by an upper blade 22*a*, (23*a*) and a lower blade 22*b*, (23*b*) which are interconnected by a pin 24, (25). The upper blades 22*a*,23*a* are movable toward but normally spring-biased to be away from the corresponding blades 22*b*,23*b*.

The operation of the gapping unit 11 is illustrated in FIGS. 5 and 6, in which the punch 17 is moved by the actuator 20 upwardly and thrusted through the coupled head portions Ea of the fastener elements E on the intermeshed stringers $F_1$, $F_2$, while the connecting portions Eb of the elements E are held by the grippers 22,23. As the fastener elements E are completely severed across the interengaged coupling heads Ea, the grippers 22,23 begin to retract horizontally away from the punch 17 and the die 18, taking along with them the residual element debris apart from the sewing threads S. The structural and functional details of such a gapping mechanism are basically well known, and hence will require no further explanation.

The feeding unit 12 essentially comprises a drive roller 26 and a pressure roller 27 for positively feeding the slide fastener chain F at a predetermined rate of speed. As better shown in FIG. 1, a pair of these rollers are provided for each of the two stringers $F_1,F_2$ in such a manner that they do not ride over or engage the beaded edges T' of interengaged stringers $F_1,F_2$ which have been given a tendency to spread apart at the pre-spreading unit 13.

Figure 7:
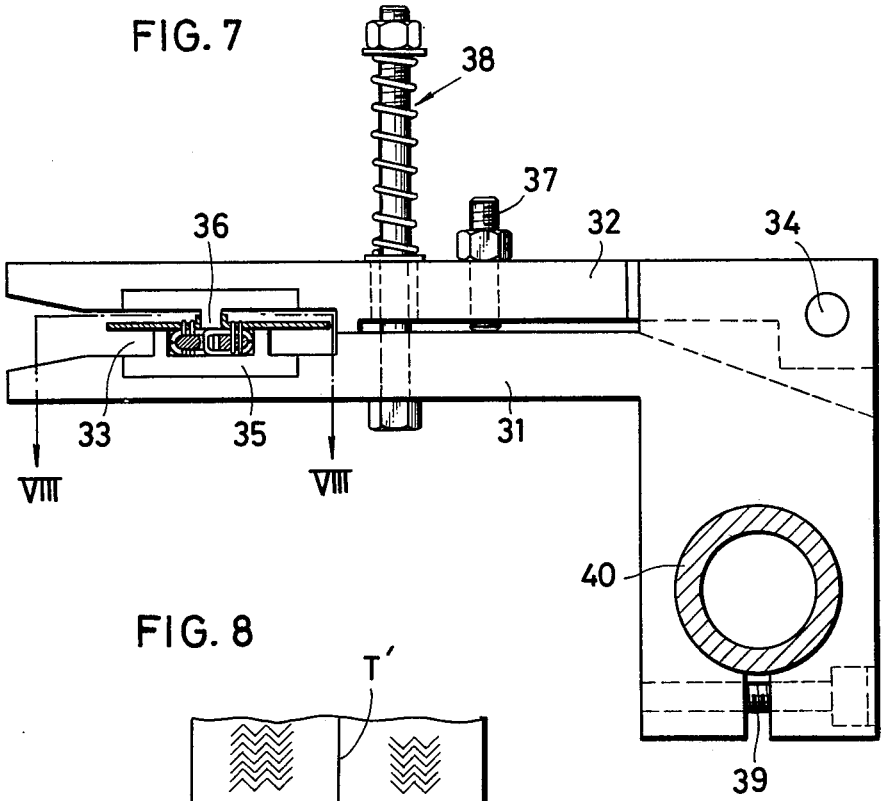
FIG. 7 is a schematic cross-sectional view taken on the line VII—VII of FIG. 3.

The pre-spreading unit 13 is located in advance or upstream of the feeding unit 12 and arranged to receive the fastener chain F which has been oriented by guide rollers 29,30 to run substantially vertically with respect to the unit 13. As better shown in FIG. 7, the pre-spreading unit 13 comprises two guide arms 31 and 32 disposed in confronting relation and defining therebetween a channel 33 for the passage of the slide fastener chain F. The first guide arms 31 is pivoted at one end about a pin 34 and is provided at the other end with a fastener element guide 35 adapted to guide the rows of interengaged fastener elements E slidably therethrough. The second guide arm 32 is provided with a wedge-shaped plunger 36 for spreading apart the confronting, abutted edges T' of the stringer tapes $T_1,T_2$.

Figure 8:
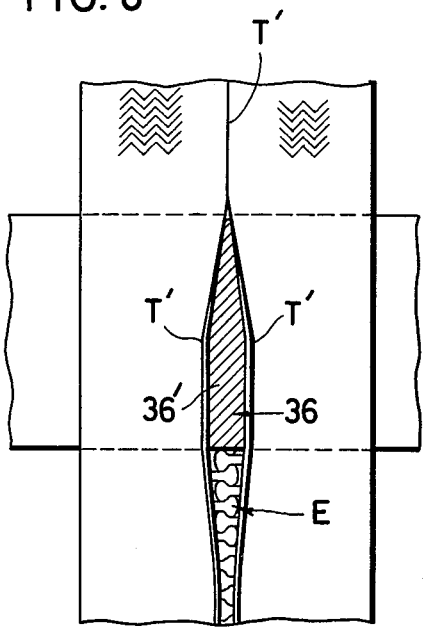
FIG. 8 is a schematic cross-sectional view taken on the line VIII—VIII of FIG. 7.

The plunger 36, as better shown in FIG. 8, is tapered off progressively in the direction of entry of the fastener chain F so that the abutted edges T' of the tapes $T_1,T_2$ can be easily spread apart on passing therethrough. A stem portion 36' of the plunger 36 is slightly greater in width that the punch head 17', so that the stringers $F_1,F_2$ are imparted a tendency, while moving past the plunger 36, to reduce their resistance to open or facilitate the spreading apart of their closed edges during the subsequent gapping operation. Designated at 37 is a bolt-and-nut stopper which is adapted to adjustably set the clearance between the first and second guide arms 31,32. Designated at 38 is a spring-biased clamping member adapted to hold the two arms 31,32 in position. The pre-spreading unit 13 thus constructed is secured, as by bolt 39, to guide bar 40 extending vertically from the frame 16.

The tensioning unit 14 is located between the feeding unit 12 and the gapping unit 11 and functions to apply and maintain a constant tension to the slide fastener chain F spanning between the feeding unit 12 and the withdrawal unit 15. The tensioning unit 14 comprises a vertically disposed guide rail 41 and a weighted roller 42 with a bearing 43 movable vertically along the rail 41, and further includes a guide roller 44 located adjacent the feeding unit 12. The rollers 42 and 44 are similar in construction to the drive and pressure roller pairs 26,27 of the feeding unit 12 in that they are all arranged to engage with the web portions of the tapes $T_1,T_2$, not with the element-carrying beaded edges T' thereof which have been pre-spread.

At the extreme upper and lower ends of the guide rail 41 are provided an upper-limit sensing element 45 and a lower-limit sensing element 46, respectively.

In the event that the speed of feed of the fastener chain F at the unit 12 is higher than the speed of withdrawal of the chain F at the unit 15, the lower sensing element 46 on contact with the bearing 43 functions to cause the feed rollers 26,27 to stop. The feed rollers 26,27 are arranged to resume rotation when the bearing 43 of the weighted roller 42 is brought into contact with the upper sensing element 45. Thus, constant tension is applied to the fastener chain F by the weight of the roller 42, regardless of the drive system.

The withdrawal unit 15 comprises a drive roller 47 and a pressure roller 48 cooperating therewith in withdrawing the fastener chain F intermittently when a cycle of gapping operation is completed at the unit 11. The withdrawal unit 15 is movably mounted via frame member 49 on a horizontal guide bar 50 extending from the frame 16. The drive roller 47 is aligned with the guide roller 44 so that the fastener chain F moves properly into and out of the space between the punch 17 and the die 18 in the gapping unit 11. The position of the withdrawal unit 15 determines the spacing or distance between adjacent gaps G along the length of the fastener chain F. To set this spacing or distance, there is provided a sensing element 51 at the withdrawal unit 15 which is arranged to sense the arrival of the trailing end of the gap G thereby causing the drive roller 47 to stop. The distance indicated by "L" in FIG. 3 measures between the center of the punch 17 and the sensing element 51 and in effect determines the spacing between adjacent gaps G that is desired.

Although various minor modifications may be suggested by those versed in the art, it should be understood that I wish to embody within the scope of the patent warranted hereon, all such embodiments as reasonably and properly come within the scope of my contribution to the art.

I claim:

1. Apparatus for producing a series of gaps free of fastener elements in and along a continuous length of slide fastener chain having a pair of oppositely disposed stringer tapes each carrying along one longitudinal edge a row of fastener elements with coupling head portions and connecting portions, which apparatus comprises: a support member; a plurality of sequentially arranged processing units mounted on said support member including a feeding unit having a drive and a pressure roller for transporting the fastener chain at a predetermined rate of speed; a pre-spreading unit having oppositely disposed guide arms, one movable relative to the other, defining therebetween a channel for the passage of the fastener chain, said unit including a plunger adapted to enter between and spread apart the confronting edges of the stringer tapes while the latter are being advanced; a tensioning unit for applying a constant tension to a length of fastener chain, said unit including a guide rail, a weighted roller with a bearing movable along said rail and a guide roller located adjacent said feeding unit; a gapping unit having coacting punch and die means for severing a group of fastener elements of said pre-spread and tensioned fastener chain length across their coupling head portions and a pair of grippers adapted to grip and remove the connecting portions of said group of elements from the respective tapes; and a withdrawal unit having a drive and a pressure roller for withdrawing the fastener chain from the apparatus intermittently along a length corresponding to the spacing between adjacent gaps to be produced in said slide fastener chain.

2. Apparatus according to claim 1 wherein said plunger in said pre-spreading unit is tapered off progressively in the direction of entry of the fastener chain and has its stem portion slightly wider than said punch in said gapping unit.

3. Apparatus according to claim 1 wherein said tensioning unit further includes sensing means engageable with said bearing respectively at upper and lower ends of said rail and adapted for starting and stopping said feeding unit.

4. Apparatus according to claim 1 wherein said withdrawal unit further includes means for sensing the arrival thereat of the trailing end of each gap in the fastener chain, the distance between said means and the center of said punch corresponding to the spacing between adjacent gaps to be produced.

* * * * *